US007143809B1

(12) United States Patent
Johansen et al.

(10) Patent No.: US 7,143,809 B1
(45) Date of Patent: Dec. 5, 2006

(54) EQUIPMENT FOR CONTINUOUS CASTING OF METAL, IN PARTICULAR ALUMINUM

(75) Inventors: Inge Johansen, Sunndalsøra (NO); Geir Mæland, Sunndalsøra (NO); Åge Strømsvåg, Sunndalsøra (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 10/009,690

(22) PCT Filed: Jun. 26, 2000

(86) PCT No.: PCT/NO00/00222

§ 371 (c)(1),
(2), (4) Date: Mar. 12, 2002

(87) PCT Pub. No.: WO01/00353

PCT Pub. Date: Jan. 4, 2001

(30) Foreign Application Priority Data

Jun. 25, 1999 (NO) ..... 19993157

(51) Int. Cl.
*B22D 11/124* (2006.01)

(52) U.S. Cl. ..... 164/440; 164/444

(58) Field of Classification Search ..... 164/487, 164/440, 490, 444, 486, 268, 472
See application file for complete search history.

(56) References Cited

U.S. PATENT DOCUMENTS 3,076,241 A * 2/1963 Simonson et al. ..... 164/472
3,556,197 A * 1/1971 Foye ..... 164/268
4,501,317 A * 2/1985 Sokolowski ..... 164/472
4,523,624 A * 6/1985 Dantzig et al. ..... 164/454
4,688,624 A 8/1987 Suzuki et al. ..... 164/440
5,205,344 A * 4/1993 Nagai et al. ..... 164/440
5,678,623 A * 10/1997 Steen et al. ..... 164/268
5,915,455 A * 6/1999 Kittilsen et al. ..... 164/440
6,609,557 B1 * 8/2003 Anderson ..... 164/459

FOREIGN PATENT DOCUMENTS

| | | |
|---|---|---|
| CH | 650 426 | 7/1985 |
| DE | 932085 | 8/1955 |
| EP | 0 337 769 A2 * | 10/1989 |
| NO | 302804 | 4/1998 |

* cited by examiner

*Primary Examiner*—Kevin P. Kerns
(74) *Attorney, Agent, or Firm*—Wenderoth, Lind & Ponack, L.L.P.

(57) ABSTRACT

Equipment for continuous, horizontal casting of metal, in particular aluminum. The horizontal casting equipment includes an insulated reservoir or pool (2), which is designed to contain liquid metal, and a releasably attached mold (3) that can be removed from the reservoir (2). An insulating plate (19) is provided with holes (25, 26) which communicate with the mold. The mold (3) includes a preferably circular mold cavity (17) having a wall (12, 13) of permeable material for the supply of oil and gas. The wall provides primary cooling to the metal being cast and at least one slit or nozzles (16) arranged along the circumference of the cavity for the direct supply of coolant, thereby providing secondary cooling of the metal. The primary cooling is so designed that it may be increased or reduced. The insulating plate (19) is replaceable and, depending on the type of alloy and the cooling required, the plate may be designed to extend along the permeable material (12, 13) in the cavity (17).

8 Claims, 3 Drawing Sheets

SECTION A-A

EQUIPMENT FOR CONTINUOUS CASTING OF METAL, IN PARTICULAR ALUMINUM

BACKGROUND OF THE INVENTION

1. Field of the Invention

The present invention concerns equipment for continuous, horizontal casting of metal, in particular aluminum. The equipment includes an insulated reservoir or pool, which is designed to contain liquid metal, and a mold, which can be removed from the pool. The mold is provided with an insulating plate having holes that communicate with the mold. The mold includes a preferably circular mold cavity having a wall of permeable material, for example graphite, for the supply of oil and/or gas. The wall provides primary cooling for the metal being cast, and at least one slit or nozzles are arranged along the circumference of the cavity for the direct supply of coolant, thereby providing secondary cooling to the metal.

2. Description of Related Art

As stated above, directly cooled horizontal casting equipment for continuous casting of metal in which oil and/or gas is supplied through the mold cavity wall through an annulus or a permeable wall element in order to form a lubricant film between the mold wall and the metal is already known.

Although this type of casting equipment functions reasonably well, the quality of the cast product is, however, much poorer than that produced by equivalent vertical casting equipment in which, in addition to oil, gas is also supplied through the cavity wall.

One of the disadvantages of vertical casting equipment is that it comprises a large number of molds. This makes it expensive to produce.

Moreover, the vertical equipment is only designed to cast specific lengths in a semi-continuous process. This also makes it expensive to operate.

Casting with horizontal casting equipment involves the use of only a few molds and the casting takes place continuously. Suitable lengths of the cast product are cut off during the casting operation. The continuous, horizontal casting equipment is thus both cheap to produce and cheap to operate.

SUMMARY OF THE INVENTION

One aim of the present invention was to produce horizontal equipment for continuous casting of metal, in particular aluminum, with which the quality of the cast product is as good as the quality of the equivalent cast product produced with vertical casting equipment. Further, an object with the present invention has been to provide equipment that is flexible with regard to casting different types of alloys.

The equipment in accordance with the present invention is characterized in that the primary cooling is designed to enable increased or reduced cooling of the metal being cast.

BRIEF DESCRIPTION OF THE DRAWINGS

The present invention will be described below in further detail using examples and with reference to the attached drawings, in which.

DETAILED DESCRIPTION OF THE INVENTION

Figure 1:
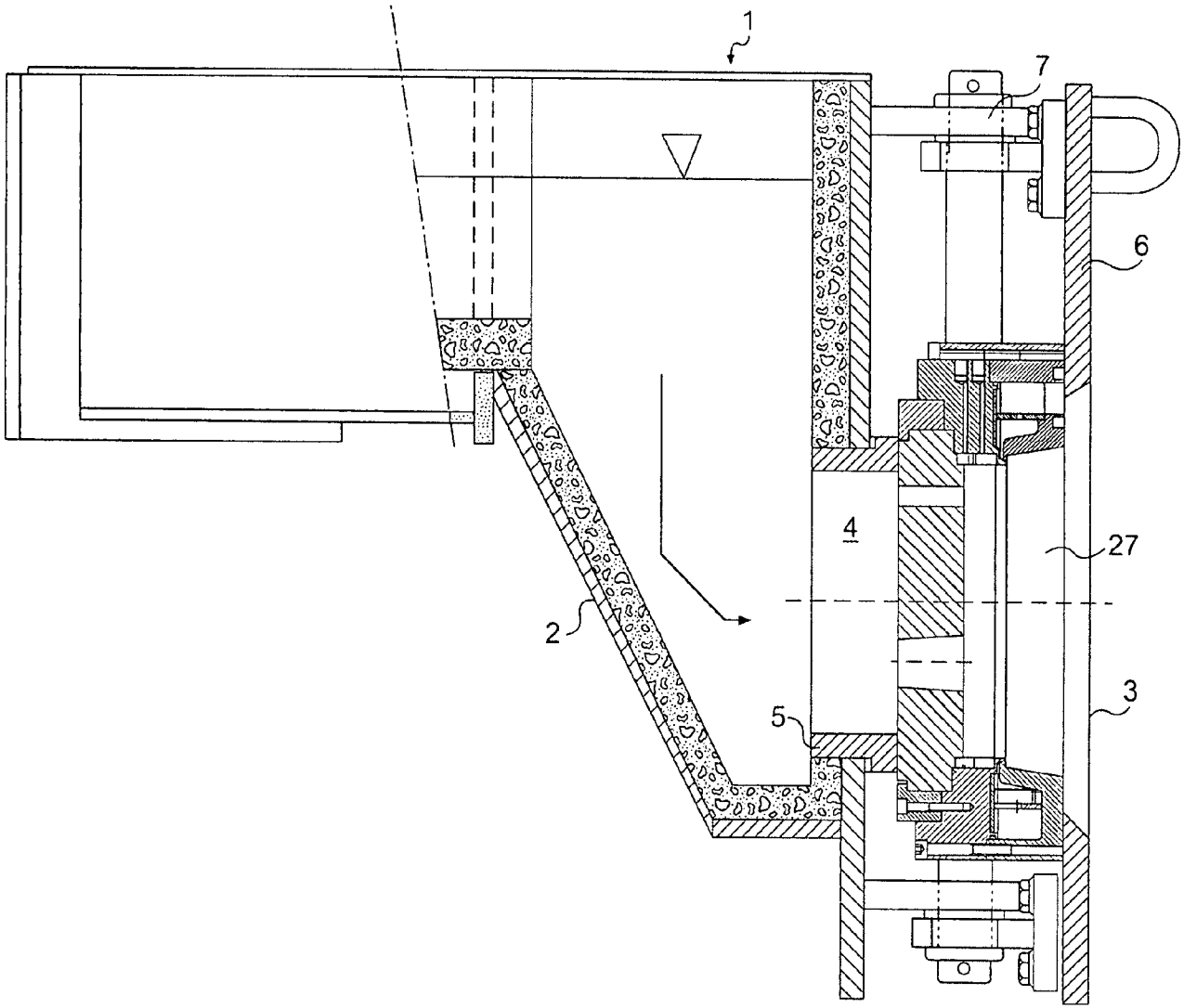
FIG. 1 shows, in part, in an elevational view of casting equipment for continuous horizontal casting of long objects, for example aluminum tie rods.

As FIG. 1 shows the casting equipment 1 constructed in accordance with the present invention. The equipment comprises an insulated metal reservoir or pool 2 and a mold 3. The pool 2 is provided with a lateral opening 4 to the mold 3, where a connecting ring 5 formed of thermally insulating material forms a transition between the pool and the mold 3. On its side, the mold is releasably attached to a holding device 6. Via a hinge link 7, it is possible to swing the holding device, and thus the mold 3, from a position in which it is in contact with the connecting ring 5 to a swung-out position which makes it possible to remove (replace) or repair the mold.

Figure 2A:
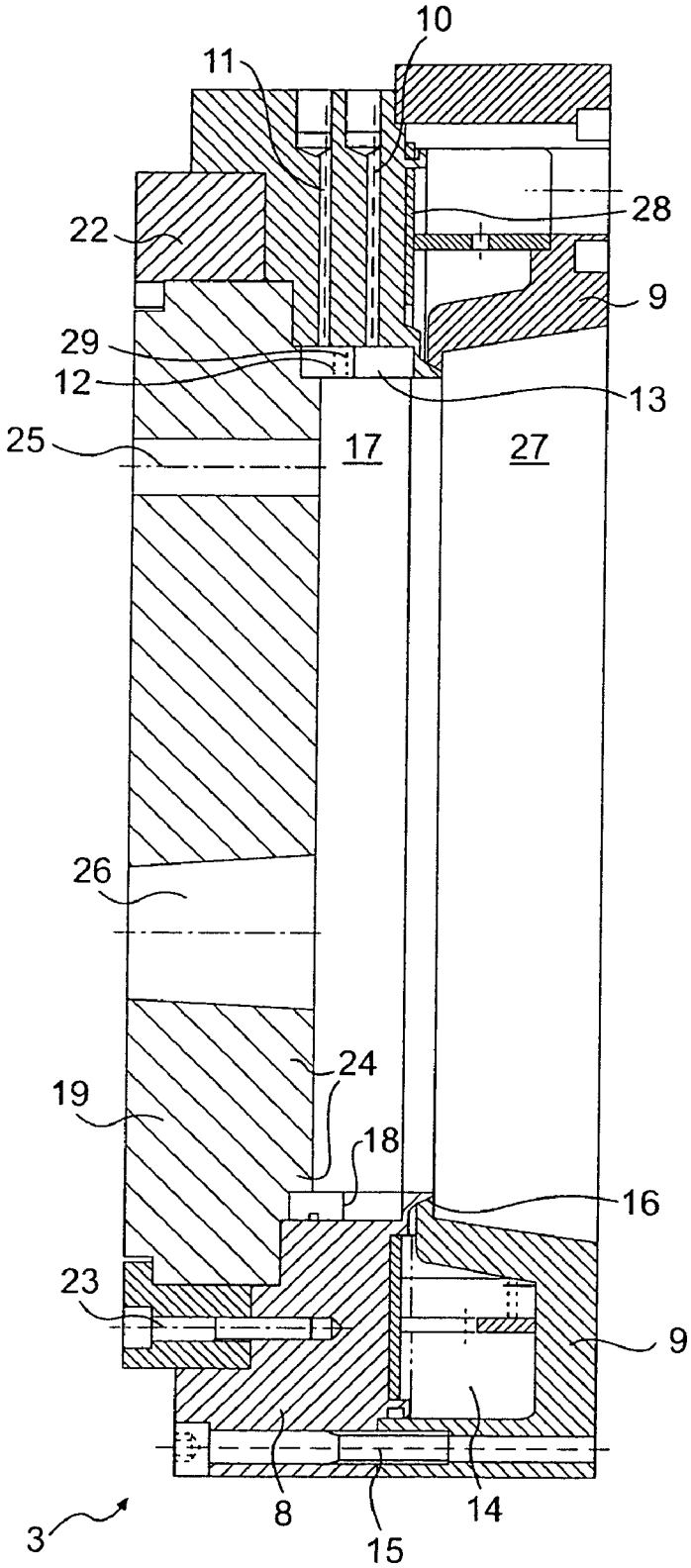
FIG. 2(*a*) shows an enlarged longitudinal section view of the mold shown in FIG. 1, taken along line A—A of FIG. 2*b* and FIG. 2(*b*) shows in a cross-sectional view taken through the mold shown in FIG. 1.
Figure 2B:
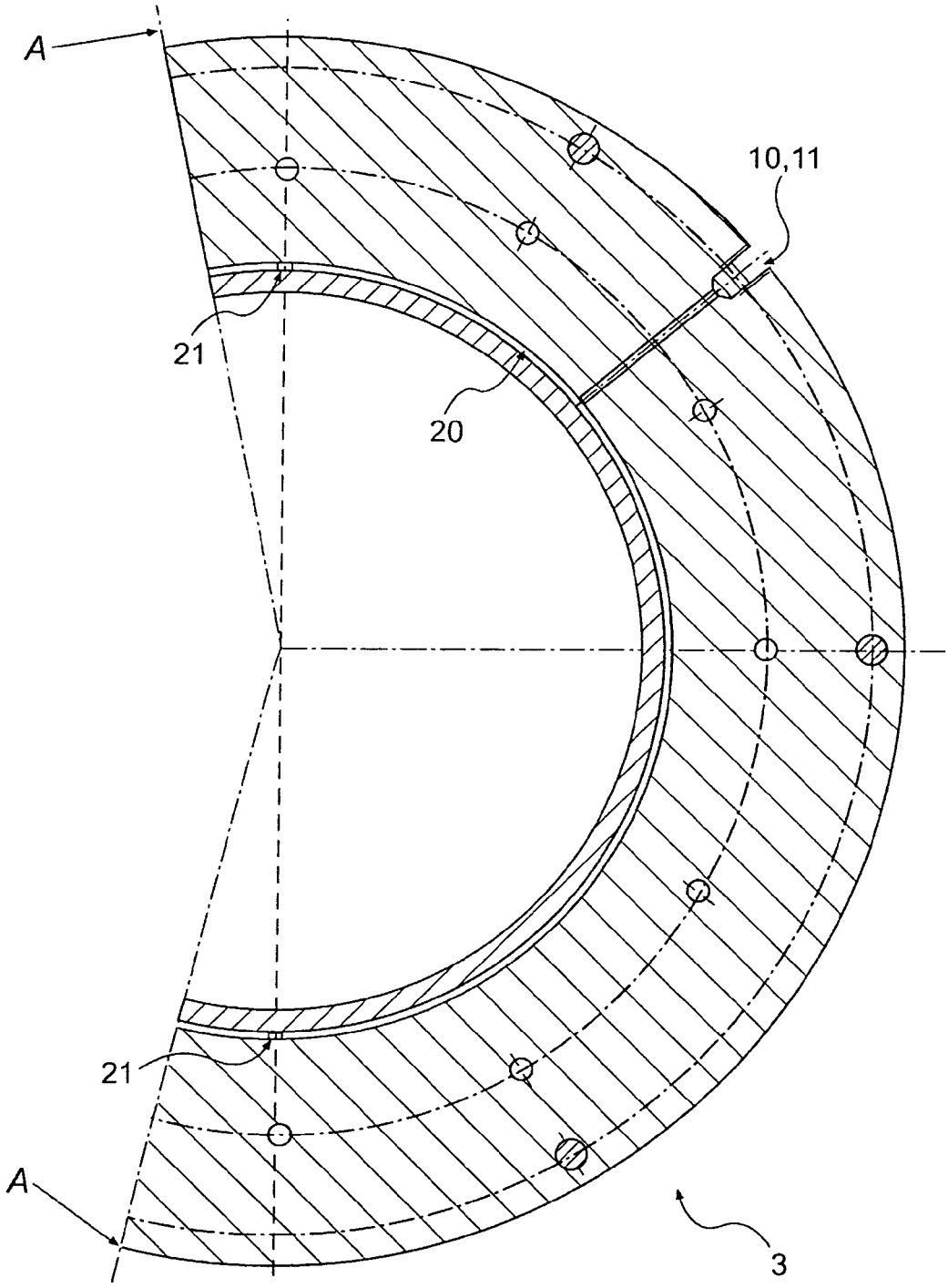

The mold itself, which is shown in further detail in FIG. 2, comprises a two-part annular housing, of which a first main housing part 8 is provided with drilled holes 10, 11 for the supply of oil or gas to interior, permeable cavity rings 12, 13. A second housing part 9 is provided with an annular recess which forms a water cooling channel 14. The two housing parts 8 and 9 are held together by means of a number of screws 15. When they are screwed together, as shown in the FIG. 2(*a*), a diagonal slit or gap 16 is formed between the two parts so that, during the casting operation, water flows from the channel 14 and through the gap 16 along the entire periphery of the cast product just outside the outlet of the cavity 17. Thereby a primary cooling circle (primary cooling of the metal being cast) is formed by transport of heat through the wall (12, 13) and to the water in the channel 14, and a secondary cooling circle is formed by the water being ejected directly on the metal through the slit 16.

As mentioned, permeable rings 12, 13, which are physically separated from each other by a gasket, sealing material 18 or the like, are included. These rings form the wall in the cavity 17.

An important feature of the present invention is that annuli 20 (see FIG. 2(*b*)) formed between the mold housing 8 and the rings 12,13 are provided with plugs 21 or similar structure (only 2 shown in the drawing) so that the annuli 20 are broken up into two or more restrictions sectors as required. In this way, the supply of both gas and oil can be differentiated along the circumference of the cavity. Such differentiation, in particular of the gas supply, is important in order to be able to achieve a good casting result.

Supply of gas to horizontal casting equipment is previously not known. To avoid inclusion of excess gas in the metal during the casting operation, a bore 29 is preferably provided in the upper part of the mold cavity. The bore extends through the ring 12 to an annulus outside the ring to another bore (now shown) leading to the atmosphere.

At the inlet of the cavity 17, there is a plate 19 formed of thermally insulating material ("hot-top") which is held in place using a retaining ring 22 via a screw connection 23.

As the wall of the cavity 17, the rings 12, 13 form the primary cooling area during the casting operation, the area of the wall surface will represent one of the factors which determine the cooling of the metal.

The insulating plate 19 may, depending on the type of alloy and the primary cooling required, extend somewhat along the ring 12 (at 24. Reference numeral 24 indicates the portion of insulating plate that extends or protrudes along the ring 12.

Since the plate can be easily detached, it will be easy to replace the plate and thus cast different types of alloy in the same mold.

Otherwise, the casting equipment in accordance with the present invention works as described below. Liquid metal, for example aluminum, is poured into the pool 2 from a casting furnace or the like (not shown). The metal flows through the opening 4 and the holes 25, 26 in the plate 19 and into the cavity 17.

At the beginning of the casting operation, the outlet 27 of the mold 3 is closed using a mobile casting shoe (not shown). As soon as the metal has filled the cavity 17, the shoe begins to move, while water is supplied through the gap 16 and gas and oil are supplied through the ring 12, 13.

As the casting shoe moves and the cavity is refilled with metal via the pool, a long casting piece is formed. The shoe is removed as soon as the casting piece has reached a certain length. Since the casting process is continuous, the casting piece may actually be of any length. However, it is expedient for the casting piece to be cut (not shown) into suitable lengths for extrusion or other purposes.

As mentioned above, the casting equipment is designed for differentiated supply of oil and gas around the circumference of the cast product.

In particular regarding the supply of gas, it has been found expedient to supply the same quantity of gas around the entire circumference of the cavity at the start of the casting process. Subsequently, when the casting process has started and has become stable, the gas supply to the upper area of the cavity is reduced or omitted.

Moreover, regarding the primary cooling, i.e. the cooling through the rings 12, 13 in the cavity 17, it has been found expedient, in order to reduce the cooling, to form the mold housing 8 of steel instead of aluminum, which is the usual material. Furthermore, in order to reduce the cooling further, it may be necessary to shield (reduce the thermal transfer to) the cooling channel 14 by arranging an insulating annular plate 28, for example of PLEXIGLAS (polymethyl-methacrylate), on the side of the housing part which faces the cooling channel. The annular plate 28 may preferably be exchangeable and be of different thickness.

The present invention as defined in the claims, is not restricted to the embodiments shown in the drawings and described above. Thus, instead of two rings (12,13) forming the wall of the mold cavity, only one ring may be employed whereby the oil and gas may be supplied through this one and only ring.

The invention claimed is:

1. Horizontal continuous casting equipment for casting of metal, said equipment comprising an insulated reservoir for containing liquid metal, and a mold removably connected to said reservoir and defining a mold cavity, said mold comprising:

a mold housing having a plurality of channels for delivering oil and gas to the mold cavity;

a primary cooling section including a circumferential wall formed of permeable wall material, provided along an interior wall of said mold housing, so as to define a wall of the mold cavity, wherein oil and/or gas can be supplied through said permeable wall material to the mold cavity;

a secondary cooling section including at least one annular slit arranged along a circumference of the cavity for directly supplying coolant into the cavity so as to provide secondary cooling of the metal being cast; and an insulating plate provided with through holes communicating said reservoir with the mold cavity, said insulating plate having a protrusion extending in an axial direction of the mold along the wall of the cavity, and the length of the protrusion is selected based on a required primary cooling effect.

2. The equipment as claimed in claim 1, wherein said mold housing is formed of steel.

3. The equipment as claimed in claim 1, wherein said mold housing comprises a first housing part surrounding said permeable wall material, a second housing part, and a thermally insulating annular plate arranged against the first housing part in order to reduce the thermal transfer between the mold cavity and an intermediate cooling channel that is defined by said first and second housing parts and said thermally insulating annular plate.

4. The equipment as claimed in claim 3, wherein said insulating annular plate is exchangeable with another insulating annular plate having a different thickness.

5. Horizontal continuous casting equipment for casting metal, said equipment comprising an insulated reservoir for containing liquid metal, and a mold removably connected to said reservoir and defining a mold cavity, said mold comprising:

a mold housing having a plurality of channels for delivering oil and gas to the mold cavity in order to permit the supply of oil and gas to be varied about the circumference of the mold cavity;

permeable wall material provided along an interior wall of said mold housing so as to define a wall of the mold cavity, wherein oil and/or gas can be supplied through said permeable wall material to the mold cavity, and heat transfer through the permeable wall material provides primary cooling to the metal being cast;

a plurality of nozzles arranged along a circumference of the cavity for directly supplying coolant into the cavity so as to provide secondary cooling of the metal being cast; and an insulating plate provided with through holes communicating said reservoir with the mold cavity, wherein said insulating plate is provided with a protrusion that extends along said permeable wall material in an axial direction of the mold such that a cooling effect is affected by the length of the protrusion.

6. The equipment as claim in claim 5, wherein said mold housing is formed of steel.

7. The equipment as claimed in claim 5, wherein said mold housing comprises a first housing part surrounding said permeable wall material, a second housing part, and a thermally insulating annular plate arranged against the first housing part in order to reduce the thermal transfer between the mold cavity and an intermediate cooling channel that is defined by said first and second housing parts and said thermally insulating annular plate.

8. The equipment as claimed in claim 7, wherein said insulating annular plate is exchangeable with other insulating annular plates having different thicknesses.

* * * * *